US011092917B2

(12) United States Patent
Tsuno et al.

(10) Patent No.: US 11,092,917 B2
(45) Date of Patent: Aug. 17, 2021

(54) FIXING UNIT

(71) Applicant: CANON KABUSHIKI KAISHA, Tokyo (JP)

(72) Inventors: Yutaro Tsuno, Abiko (JP); Youichi Chikugo, Abiko (JP); Rikiya Takemasa, Kashiwa (JP); Kenichi Tanaka, Ushiku (JP); Hidekazu Tatezawa, Soka (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/744,701

(22) Filed: Jan. 16, 2020

(65) Prior Publication Data

US 2020/0233353 A1 Jul. 23, 2020

(30) Foreign Application Priority Data

Jan. 21, 2019 (JP) ..... JP2019-007713

(51) Int. Cl.
*G03G 15/20* (2006.01)

(52) U.S. Cl.
CPC ..... *G03G 15/2053* (2013.01)

(58) Field of Classification Search
CPC ..... G03G 15/2017; G03G 15/2053; G03G 15/2064
See application file for complete search history.

(56) References Cited

U.S. PATENT DOCUMENTS

| | | | | |
|---|---|---|---|---|
| 9,104,145 | B2 | 8/2015 | Okabayashi et al. | |
| 2009/0052957 | A1* | 2/2009 | Nishinoue | G03G 15/206 399/329 |
| 2015/0248087 | A1* | 9/2015 | Kanematsu | G03G 15/2053 399/329 |
| 2017/0185019 | A1* | 6/2017 | Seo | G03G 15/2053 |
| 2018/0284663 | A1* | 10/2018 | Matsuda | G03G 15/2007 |
| 2019/0235422 | A1* | 8/2019 | Yabuki | G03G 15/2053 |
| 2019/0235428 | A1* | 8/2019 | Yabuki | G03G 15/2064 |

FOREIGN PATENT DOCUMENTS

JP 2014-222339 A 11/2014

OTHER PUBLICATIONS

Co-pending U.S. Appl. No. 16/688,176, filed Nov. 19, 2019.

* cited by examiner

*Primary Examiner* — Carla J Therrien
(74) *Attorney, Agent, or Firm* — Venable LLP

(57) ABSTRACT

A fixing unit includes an endless fixing belt, a rotary member configured to form a fixing nip portion, a resin-made pad configured to press an inner circumferential surface of the fixing belt by a peripheral surface toward the fixing nip portion, and a stay configured to support the pad. The stay includes a projection configured to protrude toward the pad. The pad includes a hole formed at a center in the width direction on the opposite surface and configured to fit with the projection.

5 Claims, 6 Drawing Sheets

FIXING UNIT

BACKGROUND OF THE INVENTION

Field of the Invention

The present invention relates to a fixing unit preferably adopted in an image forming apparatus that utilizes an electrophotography technique, such as a printer, a copying machine, a facsimile or a multifunction device.

Description of the Related Art

Image forming apparatuses are equipped with a fixing unit for fixing a toner image on a recording material by applying heat and pressure to the recording material on which an unfixed toner image is formed. A fixing belt having an endless shape, a roller, that is, pressure roller, that abuts against an outer peripheral surface of the fixing belt, a pad for pressing the fixing belt from an inner peripheral surface toward the roller, and a stay for supporting the pad are included in the fixing unit. In the fixing unit, the toner image is fixed to the recording material by nipping and conveying the recording material at a fixing nip portion formed between the fixing belt and the roller while applying heat and pressure to the recording material. The pad presses the fixing belt from the inner circumferential surface side toward the fixing nip portion to ensure nip pressure by the fixing belt.

The pad is supported on the stay in an attachable manner. In order to realize this configuration, according to Japanese Patent Application Laid-Open Publication No. 2014-222339, a rib is formed on the pad formed of resin and a groove capable of fitting the rib therein is provided on the stay formed of metal. According to the configuration of Japanese Patent Application Laid-Open Publication No. 2014-222339, the rib is formed to have a long shape that extends across the whole area of the pad in a width direction intersecting a rotational direction of the fixing belt, and the groove is formed to extend in the width direction corresponding to the rib on the pad.

There is a case where a pad including a peripheral surface having a center in a width direction intersecting the rotational direction of the fixing belt protrude toward the fixing nip portion than both edges thereof, so-called regular crown shaped, is used to press the fixing belt by the peripheral surface from an inner circumferential surface side toward the roller. However, according to the configuration disclosed in Japanese Patent Application Laid-Open Publication No. 2014-222339 described above, symmetry of the pad in the width direction tends to be lost by thermal expansion of the pad, and as a result, distribution of nip pressure in the width direction at the fixing nip portion is varied before and after thermal expansion. The distribution of nip pressure is adjusted so as not to cause fixing defects in the state where the pad is not thermally expanded, so that if the nip pressure distribution is varied by thermal expansion of the pad, fixing defects of toner image to the recording material may occur. Therefore, in a state where the pad having the above-described peripheral surface is used, there were demands for a technique that suppresses variation of nip pressure distribution in the fixing nip portion caused by thermal expansion of the pad, but hitherto, such a technique has not been provided.

SUMMARY OF THE INVENTION

According to one aspect of the present invention, a fixing unit includes an endless fixing belt configured to rotate, a rotary member configured to be in pressure contact with an outer peripheral surface of the fixing belt, and form a fixing nip portion in which a recording material, on which a toner image is formed, is nipped and conveyed while receiving pressure and heat, a resin-made pad comprising a peripheral surface in which a center in a width direction intersecting a rotational direction of the fixing belt is protruded toward the fixing nip portion than both edges thereof, and configured to press an inner circumferential surface of the fixing belt by the peripheral surface toward the fixing nip portion, and a stay configured to support the pad by supporting an opposite surface from the peripheral surface of the pad. The stay includes a projection configured to protrude toward the pad. The pad includes a hole formed at a center in the width direction on the opposite surface and configured to fit with the projection.

Further features of the present invention will become apparent from the following description of exemplary embodiments with reference to the attached drawings.

DESCRIPTION OF THE EMBODIMENTS

Image Forming Apparatus

Figure 1:
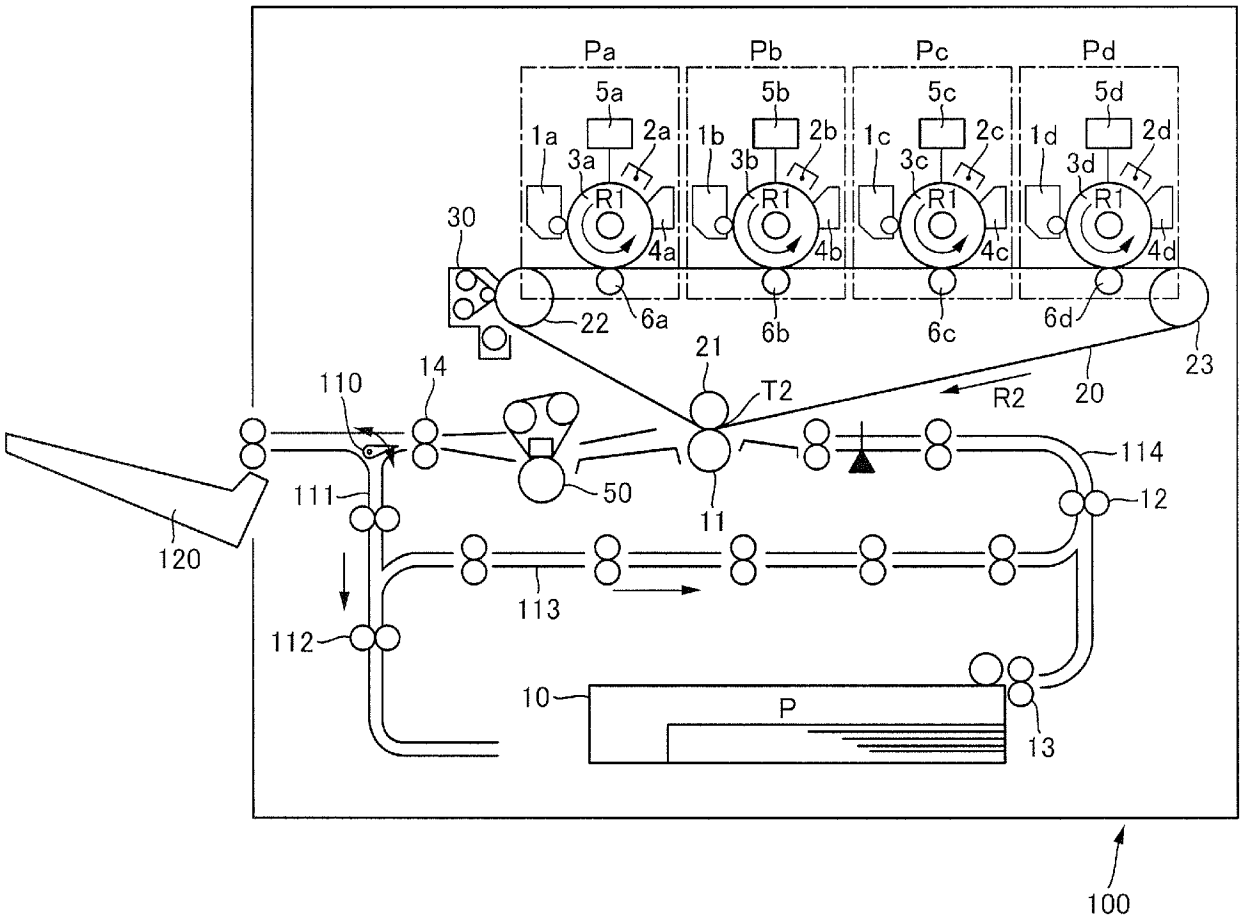
FIG. 1 is a schematic drawing illustrating a configuration of an image forming apparatus according to the present embodiment.

Now, a fixing unit according to the present embodiment will be described. At first, an image forming apparatus suitable for applying the fixing unit according to the present embodiment will be described with reference to FIG. 1. An image forming apparatus 100 according to FIG. 1 is a tandem intermediate transfer-type full-color printer in which image forming units Pa, Pb, Pc and Pd of yellow, magenta, cyan and black are arranged along an intermediate transfer belt 20.

At first, a conveyance process of a recording material according to the present image forming apparatus 100 will be described. A recording material P is stored in a manner stacked in a sheet feed cassette 10 and fed from the sheet feed cassette 10 by a sheet feed roller 13 at an image forming timing. The recording material P sent out by the sheet feed roller 13 is conveyed to a registration roller 12 arranged in midway of a conveyance path 114. After performing skew correction and timing correction of the recording material P at the registration roller 12, the recording material P is sent to a secondary transfer portion T2. The secondary transfer portion T2 is a transfer nip portion formed by a secondary transfer inner roller 21 and a secondary transfer outer roller 11, and in response to application of secondary transfer voltage to the secondary transfer outer roller 11, toner image is transferred to the recording material P.

With respect to the conveyance process of the recording material P to the secondary transfer portion T2, a process for forming an image sent at a similar timing to the secondary transfer portion T2 will be described. At first, the image forming portion will be described, wherein the image forming units Pa, Pb, Pc and Pd of respective colors are formed similarly, except for the difference in the colors of the toner used in the respective developing units 1*a*, 1*b*, 1*c* and 1*d*, which are yellow, magenta, cyan and black. Therefore, in the following description, the image forming unit Pd of black is described as an example, and the description of other image forming units Pa, Pb and Pc will be omitted.

The image forming unit Pd is mainly composed of a developing unit 1*d*, a charging unit 2*d*, a photosensitive drum 3*d*, a photosensitive drum cleaner 4*d*, and an exposing unit 5*d*. The surface of the photosensitive drum 3*d* rotated in the direction of arrow R1 in the drawing is charged uniformly in advance by the charging unit 2*d*, and thereafter, an electrostatic latent image is formed thereto by the exposing unit 5*d* driven based on an image information signal. Next, the electrostatic latent image formed on the photosensitive drum 3*d* is developed as toner image by the developing unit 1*d* using developer. Then, in response to application of primary transfer voltage to a primary transfer roller 6*d* arranged opposed to the image forming unit Pd interposing the intermediate transfer belt 20, the toner image formed on the photosensitive drum 3*d* is primarily transferred to the intermediate transfer belt 20. Primary transfer residual toner remaining slightly on the photosensitive drum 3*d* is collected by the photosensitive drum cleaner 4*d*, and the image forming unit prepares for the next image forming process.

The intermediate transfer belt 20 is stretched across the secondary transfer inner roller 21, a tension roller 22 and a stretch roller 23, and is driven in the direction of arrow R2 in the drawing. According to the present embodiment, the secondary transfer inner roller 21 also serves as a driving roller that drives the intermediate transfer belt 20. Image forming processes of various colors that are processed in parallel by image forming units Pa to Pd are performed at such timings so that each toner image is sequentially superposed to a toner image of another color primarily transferred to the intermediate transfer belt 20 at an upstream position. As a result, a full-color toner image is finally formed on the intermediate transfer belt 20 and conveyed to the secondary transfer portion T2. Secondary transfer residual toner remaining after passing the secondary transfer portion T2 is collected by a transfer cleaner device 30.

Based on the conveyance process and image forming process described above, the timing of the recording material P and the full-color toner image correspond at the secondary transfer portion T2, and secondary transfer is performed. Thereafter, the recording material P is conveyed to the fixing unit 50 where predetermined pressure and heat are applied, and the toner image is fixed to the recording material P. In the case of one-side image formation, the recording material P to which toner image has been fixed is discharged onto a sheet discharge tray 120 by a sheet discharge roller 14.

In the case of duplex image formation, the conveyance path is switched from a path leading to the sheet discharge tray 120 to a duplex conveyance path 111 by a switching member 110, so-called a flapper and the like, and the recording material P conveyed by the sheet discharge roller 14 is sent to the duplex conveyance path 111. Thereafter, leading and trailing edges of the sheet are switched by a reverse conveyance roller 112, and the sheet is sent into the conveyance path 114 again through a duplex path 113. The conveyance and image forming processes performed to the rear side are similar to that described above, so descriptions thereof will be omitted.

Fixing Unit

Figure 2:
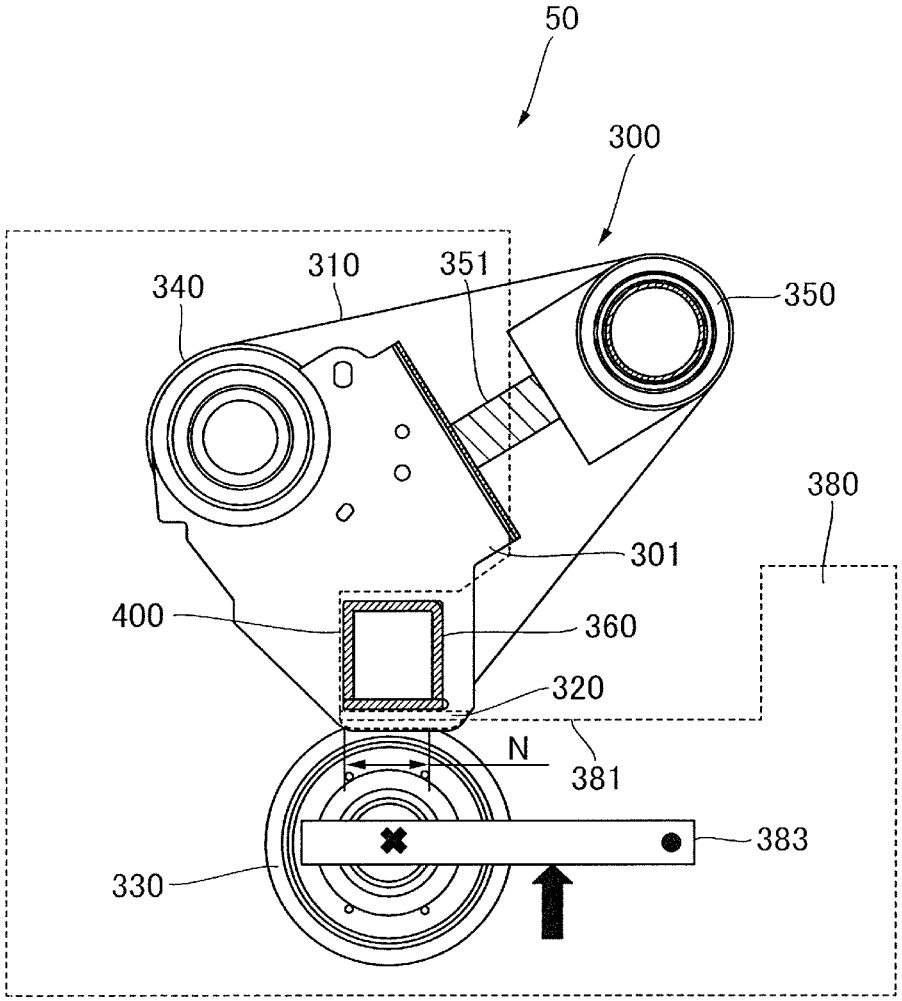
FIG. 2 is a schematic drawing illustrating a fixing unit according to the present embodiment.

Next, the fixing unit 50 according to the present embodiment will be described with reference to FIG. 2. As illustrated in FIG. 2, the fixing unit 50 according to the present embodiment can be largely divided into a belt unit 300 and a pressure roller 330. A rotation shaft of the pressure roller 330 serving as a rotary member is axially supported on a frame 380 of the fixing unit 50, and although not shown, it is rotated by a driving source through a gear. Then, the pressure roller 330 is in pressure contact with an outer peripheral surface of a fixing belt 310 of the belt unit 300 and presses the fixing belt 310. That is, the pressure roller 330 is capable of moving between a pressurizing position where it abuts against and presses the fixing belt 310 and a non-pressurizing position where it is separated from and does not press the fixing belt 310. The pressure roller 330 is supported by a pressurizing lever 383 that swings by a pressurizing motor not shown and enables the pressure roller 330 to move between the pressurizing position and the non-pressurizing position.

The pressure roller 330 can be a member having an elastic layer formed of silicone rubber, fluororubber, fluororesin and the like applied on an outer circumference of a rotation shaft formed of metal, i.e., core metal, or further having a release layer formed of fluororesin such as PTFE, PFA and FEP formed on the outer circumference of the elastic layer. In the present embodiment, a pressure roller 330 having an elastic layer with a thickness of "3 mm" formed of silicone rubber and a release layer with a thickness of "30 μm" formed of PFA is used.

Belt Unit

As illustrated in FIG. 2, the belt unit 300 mainly includes the fixing belt 310 having an endless shape, i.e., cylinder shape, and having flexibility, a heating roller 340, a steering roller 350, and a pressing member 400. According to the present embodiment, the fixing belt 310 is stretched across the heating roller 340, the steering roller 350 and the pressing member 400.

A belt including an elastic layer having high thermal conductivity and low thermal capacity, such as a resin belt formed of resin, or a belt having a composite layer structure including a metal belt formed of stainless steel (SUS) and the like as a base layer and having an elastic layer, a release layer and the like on an outer circumference thereof, can be used as the fixing belt 310. In the present embodiment, the fixing belt 310 having a base layer formed of SUS, an elastic layer formed of silicone rubber with a thermal conductivity of approximately "1.0 W/m·K" and a thickness of approximately "250 μm", and a release layer formed of a PFA tube and having a thickness of "30 μm" was used. The release layer should preferably be a sheet or a coating layer having a high release property, and for example, fluororesin such as PFA and PTFE can be used. Further, it is also possible to use a sheet material having high heat-resisting property such as polyester, polyethyrene terephtharate, polyimideamide and the like as base layer, and further having a conductive layer and a surface release layer formed thereon, as the fixing belt 310. The fixing belt 310 according to the present specification includes a thin, film-like belt.

The heating roller 340 is a stainless-steel pipe having a thickness of 1 mm, for example, and a halogen heater not shown is arranged therein. Although not shown, the heating roller 340 is rotated by a driving source through a gear. The fixing belt 310 is driven to rotate along with the rotation of the heating roller 340. Further, the temperature of the fixing belt 310 rises through the heating roller 340 by the heating roller 340 being heated by the halogen heater. The fixing belt 310 is controlled to a predetermined target temperature determined in advance based on a type of the recording material P to which the image is to be formed, based on the result of detection of a temperature sensor such as a thermistor sensor not shown.

The steering roller 350 presses the fixing belt 310 from the inner side toward the outer side to stretch the fixing belt 310 with a predetermined tension. Therefore, the steering roller 350 is urged by a spring 351. As described, the steering roller 350 has a function to apply predetermined tension to the fixing belt 310. Further, the steering roller 350 controls meandering of the fixing belt 310 in the rotational axis direction of the fixing belt 310 by steering the steering angle in a state where a center portion or one end portion of the rotational axis direction, i.e., width direction, thereof is set as a pivot fulcrum. In other words, the steering roller 350 has a function to control biasing of the fixing belt 310.

The pressing member 400 includes a stay 360 and a pressing pad 320. The stay 360 is a high-rigidity member formed of metal such as stainless steel that extends in a width direction along the fixing belt 310, and it supports the pressing pad 320 attachably on the pressure roller 330 side. According to the present embodiment, the pressing pad 320 supported on the stay 360 abuts against the inner circumferential surface of the fixing belt 310 and presses the fixing belt 310 from the inner circumferential surface toward a fixing nip portion N. Thereby, the fixing nip portion N for nipping and conveying the recording material P on which the toner image has been formed and applying pressure and heat thereto can be formed more reliably. By supporting the pressing pad 320 with the stay 360 having a high rigidity, deflection of the pressing pad 320 caused by pressure applied from the pressure roller 330 can be reduced, and a nip width that is uniform in the rotational axis direction of the pressure roller 330 can be obtained. It is preferable to interpose a lubricating sheet containing silicone oil or a lubricant such as silicon oil between the pressing pad 320 and the fixing belt 310, so that the fixing belt 310 and the pressing pad 320 are enabled to slide smoothly against one another.

The pressing pad 320 is a resin member formed to extend in a width direction intersecting the direction of rotation of the fixing belt 310 along the stay 360. The resin-made pressing pad 320 is formed of a material having insulating and heat-resisting properties, such as phenol resin, polyimide resin, polyamide resin, polyamide-imide resin, PEEK resin, PES resin, PPS resin, PFA resin, PTFE resin, and LCP resin.

The stay 360 and the pressing pad 320 will be described in detail with reference to FIGS. 3A to 4B. For sake of easier understanding, FIG. 3B illustrates the pressing pad 320 in a state reversed from the state illustrated in FIG. 3A.

Figure 3A:
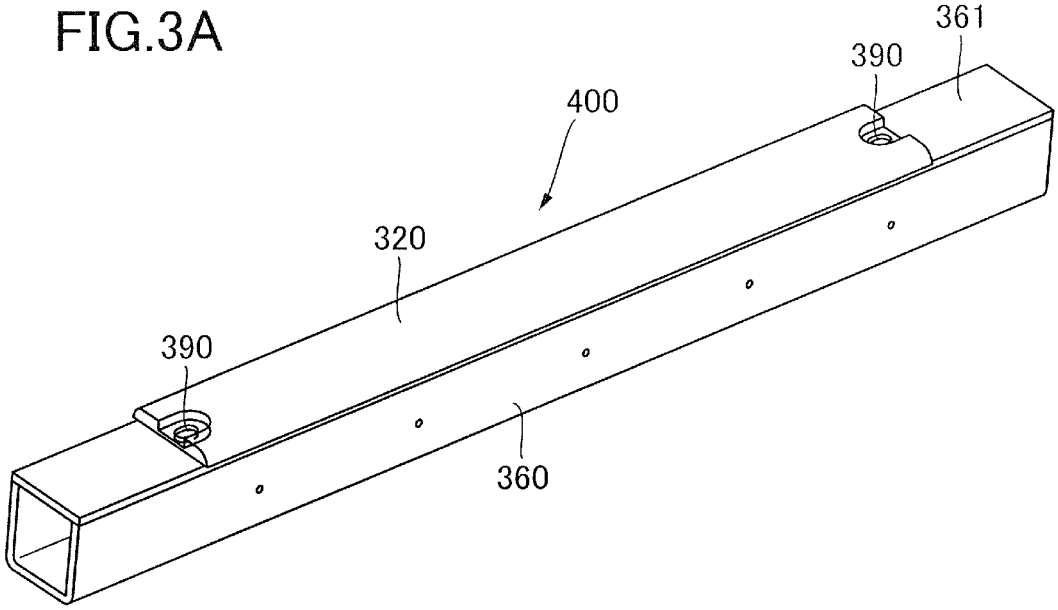
FIG. 3A is a perspective view illustrating a pressing member.
Figure 3B:
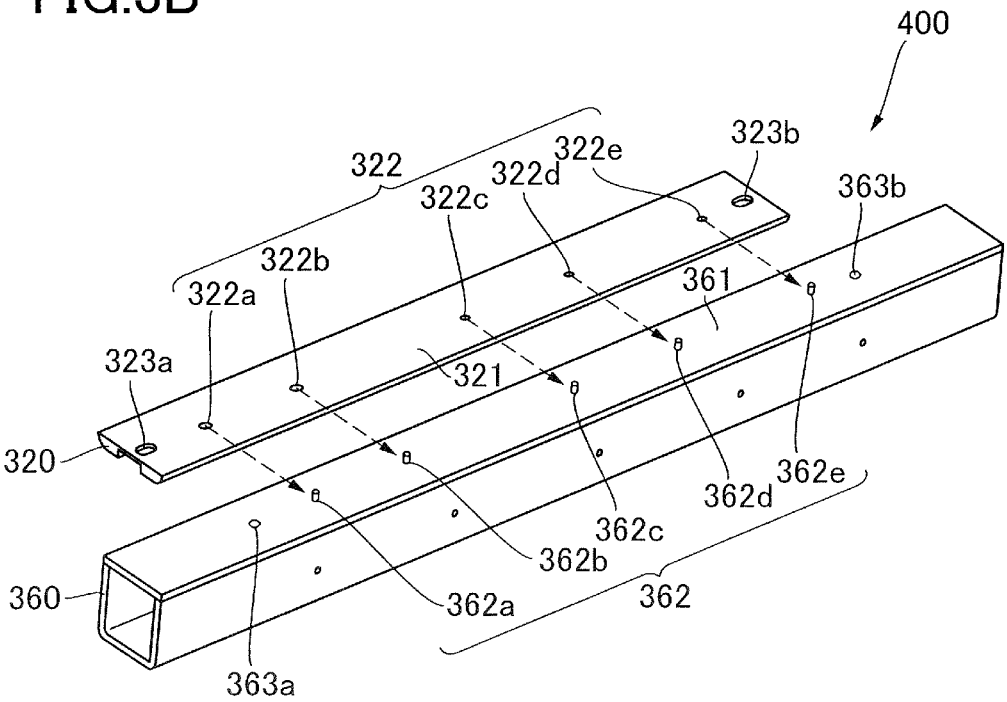
FIG. 3B is an exploded perspective view illustrating the pressing member.

As illustrated in FIGS. 3A and 3B, the pressing pad 320 is supported by a supporting surface 361 of the stay 360. A plurality of projections 362 that protrude toward the pressing pad 320, that is, toward the pad, are provided in the width direction on the supporting surface 361 of the stay 360. In the present embodiment, an example where five projections 362*a*, 362*b*, 362*c*, 362*d* and 362*e* are provided is illustrated. The projections 362 can be formed by embossing, or drawing, the stay 360, or by welding metal pins to the stay 360.

In the present embodiment, the plurality of projections 362 are provided on the stay 360, as described above. This is due to the following reasons. Sliding friction acts on the pressing pad 320 and the stay 360 from the rotating fixing belt 310. In that state, stress is concentrated to a base of the projections 362. The projections 362 are formed on the stay 360 made of metal and not on the pressing pad 320 formed of resin, so that the projections 362 will not bend or brake from the base by the stress.

Meanwhile, a plurality of non-through holes 322 are provided on an opposing surface 321, that is, back side of the peripheral surface, of the pressing pad 320 that opposes to the supporting surface 361 of the stay 360 in a manner corresponding to the plurality of projections 362 formed on the stay 360. That is, the stay 360 supports the pressing pad 320 by supporting an opposite surface of the pressing pad 320 that is opposite to the peripheral surface of the pad. As described, since five projections 362*a* to 362*e* are provided on the stay 360, five holes 322*a*, 322*b*, 322*c*, 322*d* and 322*e* are provided to correspond to each of the projections. In other words, according to the present embodiment, five sets of projections 362*a* to 362*e* and holes 322*a* to 322*e* that fit with each other are provided. The number of sets of projections 362 and holes 322 that fit with each other is not necessarily five, and at least two sets should be provided. However, one of the sets should be arranged at the center in the width direction, as described later. Further, the holes 322 are formed as non-through holes in the present embodiment, but they can also be through-holes. However, non-through holes are preferable since appropriate distribution of nip pressure at the fixing nip portion N in the width direction can be realized more easily.

Further, screw holes 363*a* and 363*b* are formed at both end portions in the width direction of the stay 360. Further, through-holes 323*a* and 323*b* are formed at positions corresponding to the screw holes 363*a* and 363*b* of the stay 360 at both end portions in the width direction of the pressing pad 320. The screw holes 363*a* and 363*b* and the through-holes 323*a* and 323*b* are provided to fix the pressing pad 320 to the stay 360 by screws 390 serving as a fixing member. That is, the pressing pad 320 is screwed onto the stay 360 by screws 390 through the through-holes 323*a* and 323*b* in a state where the holes 322*a* to 322*e* are respectively fit to the projections 362*a* to 362*e* and the pressing pad 320 is mounted on the supporting surface 361 of the stay 360.

Figure 4A:
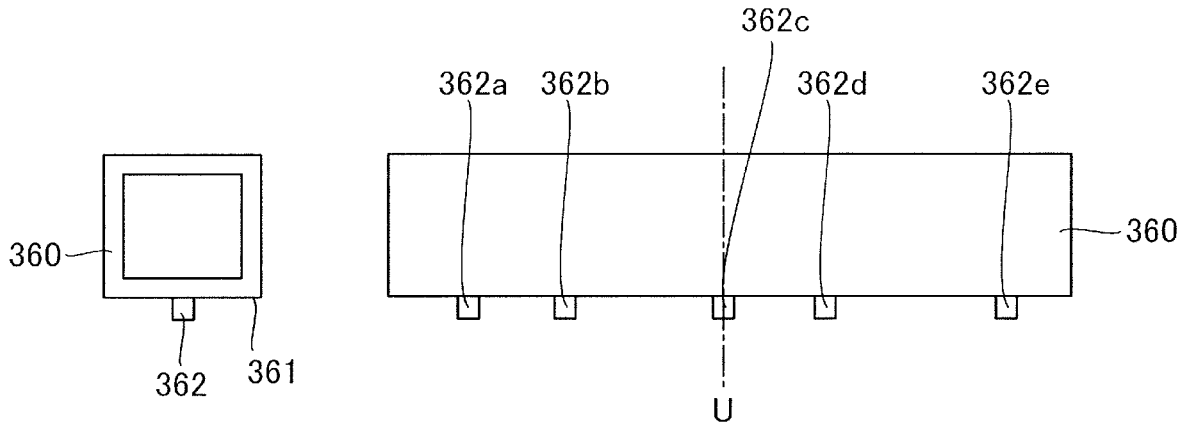
FIG. 4A is a schematic view of the pressing member, illustrating a stay.
Figure 4B:
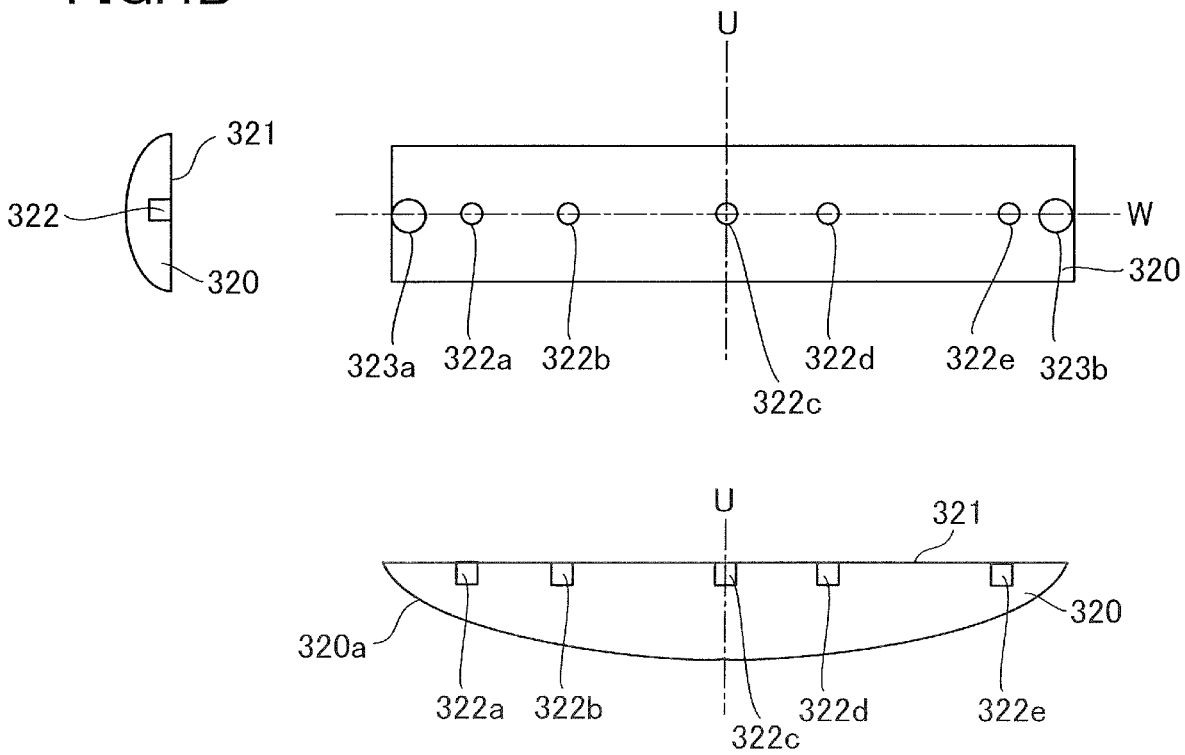
FIG. 4B is a schematic view of the pressing member, illustrating a pressing pad.

In the case of the present embodiment, one set of the projections 362*a* to 362*e* and the holes 322*a* to 322*e* that fit with each other is arranged at a center position in the width direction. As shown in FIG. 4A, the projection 362*c* among the projections 362*a* to 362*e* on the stay 360 is positioned on a straight line U that passes the center in the width direction of the stay 360. It is noted that the center in the width direction of the stay 360 includes a range of ±2% length in the width direction of the stay 360 from the center position of the stay 360 Further, as illustrated in FIG. 4B, the hole 322*c* among the holes 322*a* to 322*e* on the pressing pad 320 is arranged to be positioned on a straight line U that passes the center in the width direction of the pressing pad 320. It is noted that the center in the width direction of the pressing pad 320 includes a range of ±2% length in the width direction of the pressing pad 320 from the center position of the pressing pad 320. The holes 322*a* to 322*e* and the projections 362*a* to 362*e*, although not shown, are arranged along a same straight line W with respect to the direction of rotation of the fixing belt 310 (refer to FIG. 2).

According to the present embodiment, lengths in the width direction differ between the hole 322*c* at the center in the width direction and the holes 322*a*, 322*b*, 322*d* and 322*e* that are formed at positions other than the width-direction center. The lengths of the holes 322*a*, 322*b*, 322*d* and 322*e* in the width direction are longer than the length of the hole 322*c* in the with direction positioned at the center in the width direction. That is, the hole 322*c* is formed to have a shape and size that corresponds to the shape of the projection 362*c*. For example, if the projection 362*c* is formed of a pin having a columnar shaft portion, the hole 322*c* should be formed in a circular shape having a diameter that corresponds to a diameter of the shaft portion of the pin to be fit thereto. That is, in a fit state, the projection 362*c* and the hole 322*c* are fit without a gap formed in both the rotational and width directions. In contrast, the other holes 322*a*, 322*b*, 322*d* 322*e* are formed to have the same size in the rotational direction as the hole 322*c* but a longer length in the width direction. In the fit state, there are no gaps formed between the projections 362*a*, 362*b*, 362*d* and 362*e* and the holes 322*a*, 322*b*, 322*d* and 322*e* in the rotational direction, but there are gaps formed therebetween in the width direction.

In the case of the present embodiment, as illustrated in FIG. 4B, the pressing pad 320 includes a peripheral surface 320*a* having its center portion in the width direction protrude toward the fixing nip portion N than both edges thereof. Specifically, the peripheral surface 320*a* of the pressing pad 320 that slides against the fixing belt 310 is formed to have a regular crown shape where a radius of curvature is reduced continuously from a center portion in the width direction toward both edges thereof. In this case, if the projection 362*c* is loosely-fit to the hole 322*c* as described above, the positioning of the pressing pad 320 with respect to the stay 360 is performed in a state where a peak portion of the peripheral surface 320*a*, that is, the center position where the radius of curvature is maximum, is set as reference. In the present embodiment, positioning of the pressing pad 320 is performed so that the peak portion of the peripheral surface 320*a* is positioned at the center position of the fixing nip portion N.

According to the present embodiment, as illustrated in FIG. 4A, the projections 362*a*, 362*b*, 362*d* and 362*e* excluding the projection 362*c* are arranged on the stay 360 at asymmetric positions in the width direction in a state where the projection 362*c* positioned at the center in the width direction is set as reference. In correspondence therewith, as illustrated in FIG. 4B, the holes 322*a*, 322*b*, 322*d* and 322*e* are arranged at asymmetric positions in the width direction in a state where the hole 322*c* positioned at the center in the width direction is set as reference. This arrangement is adopted to prevent the pressing pad 320 from being attached in a reversed manner to the stay 360. That is, with respect to the direction of conveyance of the recording material S in the fixing unit 50, in further detail, the fixing nip portion N, the level in which the pressing pad 320 obstructs the rotation of the fixing belt 310 varies according to the edge shapes of the pressing pad 320. Therefore, the edge shapes of an upstream edge and a downstream edge of the pressing pad 320 are varied. However, if the pressing pad 320 is attached in a reversed manner to the stay 360 by which the upstream side and the downstream side of the pressing pad 320 are reversed, the upstream-side edge and the downstream-side edge of the pressing pad 320 will not be positioned at the target positions with respect to the fixing belt 310. Then, the level in which the pressing pad 320 obstructs the rotation of the fixing belt 310 is varied greatly, so it is not preferable for the pressing pad 320 to be attached to the stay 360 in a reversed manner. Therefore, in order to prevent the pressing pad 320 from being attached in a reversed manner to the stay 360, according to the present embodiment, the projections 362*a* to 362*e* and the holes 322*a* to 322*e* which fit with each other are arranged at asymmetric positions.

Further according to the present invention, as illustrated in FIG. 4B, the through-holes 323*a* and 323*b* for fixing the pressing pad 320 are formed on a same line as the holes 322*a* to 322*e* in the direction of rotation of the fixing belt 310 (refer to straight line W).

As described, according to the present embodiment, the positioning of the pressing pad 320 with respect to the stay 360 in the width direction is performed by one set of projection 362*c* and hole 322*c* formed at the center in the width direction in a state where the peak portion, i.e., center position, of the peripheral surface 320*a* of the pressing pad 320 is set as reference. This is because according to the present embodiment, the pressing pad 320 deforms by thermal expansion from the center in the width direction toward both edge portions in a state where the projection 362*c* and the hole 322*c* is set as reference. Therefore, the pressing pad 320 is supported on the stay 360 so that the set of projection 362*c* and hole 322*c* formed at the center in the width direction is fit without a gap formed therebetween while the other sets of projections 362 and holes 322 are fit with a gap formed in the width direction. Since the other sets of projections 362 and holes 322 are fit with a gap formed in the width direction, in a state where the pressing pad 320 is thermally expanded, the deformation of the pressing pad 320 is not suppressed compared to the center of the width direction, so that symmetry of the pressing pad 320 in the width direction in a state where the center of the width direction is set as reference is not deteriorated. Therefore, even if the pressing pad 320 is thermally expanded, the peak portion, i.e., center position, of the peripheral surface 320*a* of the pressing pad 320 is not easily deviated from the center position of the fixing nip portion N. Since the peak portion of the peripheral surface 320*a* of the pressing pad 320 is not deviated from the center position of the fixing nip portion N, the variation of nip pressure distribution in the width direction of the fixing nip portion N caused by thermal expansion of the pressing pad 320 can be suppressed.

Other Embodiments

Figure 5:
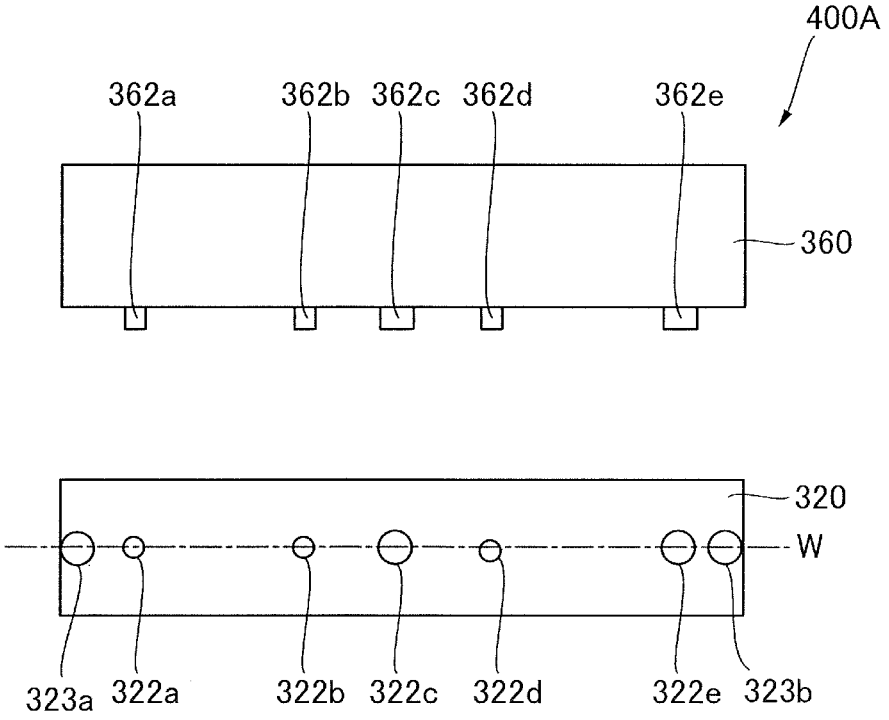
FIG. 5 is an exploded view illustrating another embodiment of a pressing member.

The configuration for preventing the pressing pad 320 from being attached in a reversed manner to the stay 360 is not limited to the embodiment described above. FIG. 5 illustrates another embodiment of a pressing member. A pressing member 400A illustrated in FIG. 5 is arranged so that one set of projection 362*c* and hole 322*c* arranged at a center in the width direction is set as reference, and other sets of projections 362*a*, 362*b*, 362*d* and 362*e* and holes 322*a*, 322*b*, 322*d* and 322*e* are arranged symmetrically in the width direction. Among the sets of projections and holes arranged symmetrically, the size, such as the diameter, of one set of projection 362*e* and hole 322*e* differs from the other sets. Thereby, attaching of the pressing pad 320 in a reversed manner to the stay 360 is prevented. The size has been differed according to the example, but the shape can be differed instead.

Figure 6:
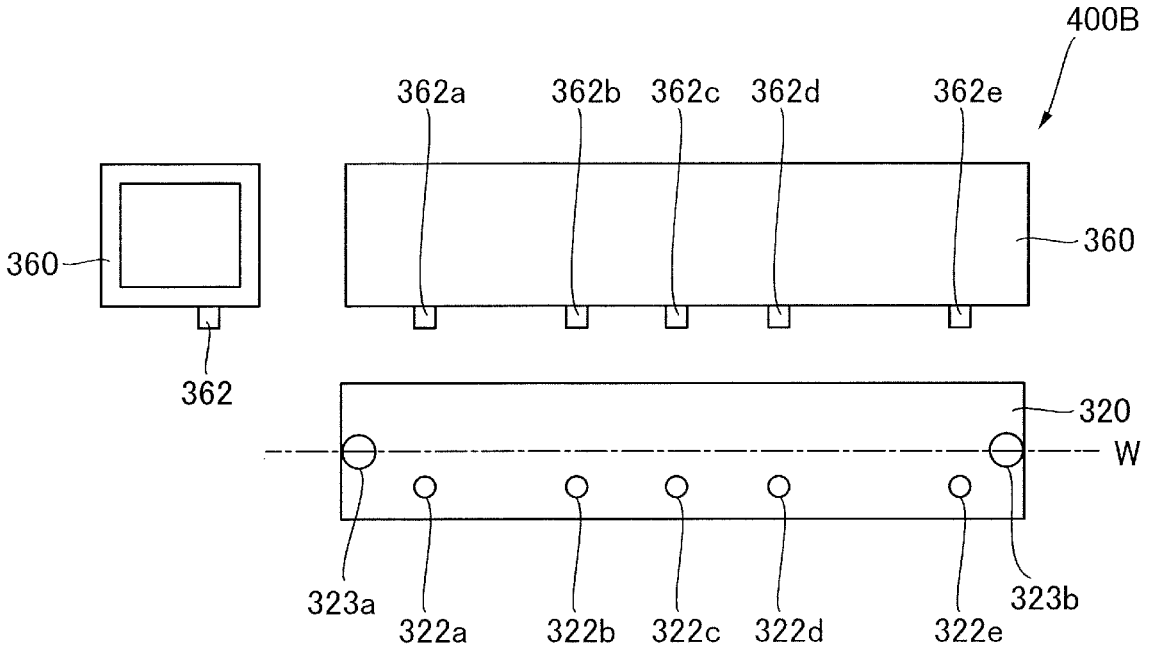
FIG. 6 is an exploded view illustrating yet another embodiment of a pressing member.

FIG. 6 illustrates yet another embodiment of a pressing member. A pressing member 400B illustrated in FIG. 6 also has one set of projection 362*c* and hole 322*c* arranged at a center in the width direction set as reference, and other sets of projections 362*a*, 362*b*, 362*d* and 362*e* and holes 322*a*, 322*b*, 322*d* and 322*e* are arranged symmetrically in the width direction. However, unlike the pressing member 400A illustrated in FIG. 5, all the sets of projections 362*a* to 362*e* and holes 322*a* to 322*e* are biased toward an edge portion from the center with respect to the direction of rotation of the fixing belt 310. Then, if the pressing pad 320 is attached in a reversed manner to the stay 360, the pressing pad 320 is supported in a manner protruded to the upstream side (or the downstream side) from the stay 360, so that the user can easily visually confirm whether the pressing pad 320 is attached in a reversed manner. Thereby, reverse attachment of the pressing pad 320 to the stay 360 is prevented.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2019-007713, filed Jan. 21, 2019, which is hereby incorporated by reference herein in its entirety.

What is claimed is:

1. A fixing unit comprising:

an endless fixing belt configured to rotate;

a rotary member configured to be in pressure contact with an outer peripheral surface of the fixing belt, and form a fixing nip portion in which a recording material, on which a toner image is formed, is nipped and conveyed while receiving pressure and heat;

a resin-made pad comprising a peripheral surface configured such that a center portion of the pad, in a width direction intersecting a rotational direction of the fixing belt, is more protruded toward the fixing nip portion than both edges of the pad, and configured to press an inner circumferential surface of the fixing belt by the peripheral surface toward the fixing nip portion;

a metal-made stay configured to support the pad by supporting an opposite surface from the peripheral surface of the pad; and first and second screws, wherein the stay comprises a plurality of projections provided in the width direction on a surface supporting the pad, wherein the pad comprises a plurality of holes provided on the opposite surface and each hole is configured to engage with each respective projection, wherein the plurality of holes is an odd number of holes and one of the holes is provided at the center portion, and wherein the first screw is configured to attach the pad to the stay at a first position and the second screw is configured to attach the pad to the stay at a second position opposite from the first position in the width direction across the plurality of projections, and no screw is provided between the first and second screws in the width direction for attaching the pad to the stay.

2. The fixing unit according to claim 1, wherein a length in the width direction of a hole other than the hole formed at the center portion in the width direction is longer than a length in the width direction of the hole formed at the center portion in the width direction.

3. The fixing unit according to claim 1, wherein the plurality of projections and the plurality of holes that fit with each other are arranged asymmetrically in a state where one set of the projection and the hole formed at the center portion in the width direction is set as reference.

4. The fixing unit according to claim 1, wherein the plurality of projections and the plurality of holes that fit with each other are arranged symmetrically in a state where one set of the projection and the hole formed at the center portion in the width direction is set as reference, and excluding the one set of the projection and the hole formed at the center portion in the width direction, a size or a shape of at least one of the sets of the projections and the holes differs from a size or a shape of another of at least one of the sets of the projections and the holes.

5. The fixing unit according to claim 1, wherein the plurality of projections and the plurality of holes are arranged at positions biased toward one of the edges from a center, in a direction of rotation of the fixing belt, of the pad.

* * * * *